US006058678A

United States Patent [19]

Lees

[11] Patent Number: 6,058,678

[45] Date of Patent: May 9, 2000

[54] INFEED STERILIZER FOR A PACKAGING MACHINE

[75] Inventor: John Lees, Minneapolis, Minn.

[73] Assignee: Tetra Laval Holdings & Finance, SA, Pully, Switzerland

[21] Appl. No.: 09/141,716

[22] Filed: Aug. 28, 1998

[51] Int. Cl.[7] ..... B65B 55/04

[52] U.S. Cl. ..... 53/426; 53/167

[58] Field of Search ..... 53/167, 425, 426, 53/565

[56] References Cited

U.S. PATENT DOCUMENTS

| | | | |
|---|---|---|---|
| 3,566,575 | 3/1971 | Lisiecki | 53/426 |
| 3,579,958 | 5/1971 | Hentges et al. | 53/565 |
| 4,375,145 | 3/1983 | Mosse et al. | 53/425 |
| 4,506,491 | 3/1985 | Joosten et al. | 53/426 |
| 4,566,251 | 1/1986 | Spisak et al. | 53/167 |
| 4,590,734 | 5/1986 | Ueda | 53/167 X |
| 4,590,740 | 6/1986 | Rodocker | 53/426 |
| 4,683,701 | 8/1987 | Rangwala et al. | 53/426 X |
| 4,963,335 | 10/1990 | Adachi et al. | 422/302 |
| 5,122,340 | 6/1992 | Shimamura et al. | 53/425 X |

FOREIGN PATENT DOCUMENTS

| | | | |
|---|---|---|---|
| 3626 | 1/1991 | Japan | 53/426 |
| 597128 | 4/1993 | Japan | 53/426 |

*Primary Examiner*—Daniel B. Moon
*Attorney, Agent, or Firm*—Welsh & Katz, Ltd.

[57] ABSTRACT

An infeed sterilizer for a packaging machine that allows for the entire sterilization of an erected carton blank prior to bottom forming. The infeed sterilizer includes a nip roller, a carousel, sterilization means and a sterilization chamber. The carousel has a plurality of carriers for temporarily holding a plurality of erected carton blanks wherein each erected carton blank has both the top and bottom ends open and unfolded or sealed. The sterilization means may be hydrogen peroxide, ultraviolet energy, hot air, electron beams, any combination thereof. The sterilization chamber may be pressurized with sterile air to reduce contamination/recontamination of the erected carton blanks. The sterilized cartons may be transferred to a form and fill carousel disposed above the infeed sterilizer for bottom forming and filling.

12 Claims, 5 Drawing Sheets

INFEED STERILIZER FOR A PACKAGING MACHINE

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to filling machines. Specifically, the present invention relates to a packaging machine for forming, filling and sealing a carton from a blank.

2. Description of the Related Art

Milk or juice is often packaged in containers that have been sterilized to prolong shelf life of the contents under refrigeration. When milk or juice is being packaged under aseptic packaging conditions, the contents are capable of being stored for a substantial period of time at room temperature without spoilage. Such packaging processes require effective sterilization of the packaging material prior to filling of a container formed from the packaging material. For example, a container, such as a gable-top carton, that has previously been partially formed may have its interior surfaces sterilized prior to being filled with product. U.S. Pat. No. 4,375,145, discloses a packaging machine having a conveyor on which pre-formed cartons advance under ultraviolet germicidal solution, such as hydrogen peroxide, passing under the ultraviolet lamps.

A popular type of packaged product is an Extended Shelf Life ("ESL") packaged product due to the added value such a filled container presents to a retailer. For example, pasteurized milk processed and packaged under typical conditions has a shelf life at four degrees Celsius of seven to fourteen days while the same milk processed and packaged under ESL conditions has a shelf life of fourteen to sixty days. Under ESL conditions, juice may have a shelf life of forty to one-hundred twenty days, liquid eggs sixty to ninety days, and eggnog forty-five to sixty days. Thus, ESL packaging greatly enhances a product since it extends the time period that the particular product may be offered for sale to the consuming public. In order to have ESL filling, the filling system should be kept sterile in order to prevent contamination of the product or container during filling on a form, fill and seal package machine.

Many ESL machines use UV light and hydrogen peroxide. However, UV lamps greatly increase the price of a packaging machine and require extensive monitoring and maintenance to operate properly.

Another problem with current sterilization practices is the limitation of concentration of hydrogen peroxide that may be used on packaging material for food. Only a minute quantity of hydrogen peroxide residue may be found on the packaging that limits most applications to less than 1% concentration, and requiring UV light. However, as mentioned above, UV lamps and associated components are very expensive and require more maintenance and energy than machines without UV lamps.

Another popular type of packaged product is an aseptic packaged product due to the tremendous value such a filled container presents to a retailer. For example, ultra high temperature processed milk may have a non-refrigerated shelf life of over one-year in a TETRA BRIK® Aseptic package. Such a package is fabricated from a web of packaging material on a vertical form, fill and seal packaging machine that is substantially enclosed except for an outlet for the final package. It is quite apparent that producing a package capable of non-refrigerated distribution is highly desirable, however, the packaging machine must be substantially enclosed to prevent any and all contamination of the product, the machine or the packaging material.

In the area of aseptic linear form, fill and seal packaging machines, wherein a series of container blanks are utilized instead of a web of packaging material, the maintenance of the entire machine in a non-contaminated enclosed environment is highly critical. One such machine is disclosed in U.S. Pat. No. 5,660,100 wherein a preheating zone, a sterilizing zone, a drying zone, a filling zone and a closure zone are all enclosed within a single sterile space that optimizes hermeticity. A hydrogen peroxide aerosol or liquid is utilized to sterilize the packages and the enclosure. As is apparent, the hermetically sealed environment is the most important factor in maintaining the aseptic environment. Such an environment increases the price of the machine and requires substantial maintenance.

Another machine is disclosed in U.S. Pat. No. 4,992,247 wherein a container sterilization system is adaptable to a form, fill and seal machine. The system is a closed loop system having a chamber, a blower for directing a mixture of air, vaporized hydrogen peroxide and vaporized water through ductwork and to a vapor delivery inlet manifold disposed above a line of conveyors conveyed therethrough the system. An exhaust manifold is positioned below the containers to receive the mixture. An iso-box is positioned at the front of the inlet manifold to serve as an air lock or curtain to prevent outside contaminants from entering the chamber and to prevent vaporized hydrogen peroxide from leaving the chamber. Containers enter the iso-box before entering the chamber. In the chamber, hydrogen peroxide condenses on the inner surfaces of each of the containers prior to exiting through another iso-box. As each container moves through the chamber, liquid hydrogen peroxide condenses on inner surfaces and eventually equilibrium is reached between the liquid and vapor hydrogen peroxide. The pre-heating temperatures and the processing temperatures are controlled to maintain the sterilizing effect. After the iso-box is a drying air inlet manifold having heated air flowing from a HEPA filter. Although U.S. Pat. No. 4,992,247 discloses that the system is positioned between a bottom forming station and a top sealing station, it is assumed that a filling station is disposed adjacent the drying manifold. It is important in U.S. Pat. No. 4,992,247 that the hydrogen peroxide condense on the containers in order to have the desired "scrubbing" effect.

An ESL machine is capable of producing a large number of containers per hour of operation and allows for an "open" operating environment as compared to an aseptic machine that requires a substantially enclosed environment for most of the machine to prevent contamination of the packaging material, product and machinery. However, the aseptic container is capable of non-refrigerated storage for long periods of time. In the sterilized package stage, positioned between ESL packages and aseptic packages, are high acid ambient distribution ("HAAD") packages. The HAAD package is capable of non-refrigerated storage, however, the product must have a minimum acidity (pH less than 4.6) such as the acidity of orange juice (pH 2.8) as compared to the acidity of milk (pH 6.9) which is an unacceptable product for a HAAD package.

Current packaging machines utilized to form, fill and seal a carton to produce either an extended shelf life ("ESL") product or a shelf stable aseptic product, are often very large in that the area (also referred to as the "footprint") occupied is upwards to thirty square meters (usually 10 meters in length by 3 meters in width). The size of these machines present many problems for a dairy or other facility that may have a need for a packaging machine capable of producing aseptic or ESL products. The most obvious is the size, in that some dairies are just too small to accommodate such a machine. Next, a larger machine requires a greater amount of chemicals and other supplies to disinfect the machine after every production cycle. Further, a greater amount of labor is required too not only disinfect but maintain the machine in an operational manner.

Another problem with current packaging machines is the inability to sterilize an entire carton since in a typical packaging machine the bottom is formed and sealed prior to sterilization.

BRIEF SUMMARY OF THE INVENTION

The present invention is able to resolve the problems of the prior art by proving an infeed sterilizer that allows for the sterilization of the entire carton prior to bottom forming. The present invention also allows for proper sterilization to occur in a more compact packaging machine.

One aspect of the present invention is an infeed sterilizer generally having a nip roller, a sterilization carousel, sterilization means and a sterilization chamber. The chamber encloses the carousel and a portion of the nip roller. The carousel will have a plurality of carriers connected thereon for temporarily holding a plurality of erected carton blanks during indexed rotation of the carrousel. The blanks have both their top and bottom ends open allowing for sterilization of the entire carton. The sterilization means may be hydrogen peroxide, ultraviolet energy, electron beams, hot air, or any combination thereon. The infeed sterilizer may also have a conveyor for transferring the blanks to the carousel, or a conventional bottom forming mandrel wheel.

Another aspect of the present invention is a packaging machine having an infeed sterilizer as described above. The packaging machine would also have a means for transferring the sterilized cartons from the infeed sterilizer to a form and fill carousel disposed on a level above the sterilization carousel.

Another aspect of the present invention is a method for sterilizing a plurality of cartons before bottom forming of each of the cartons.

Having briefly described this invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

Several features of the present invention are further described in connection with the accompanying drawings in which.

DETAILED DESCRIPTION OF THE INVENTION

Figure 1:
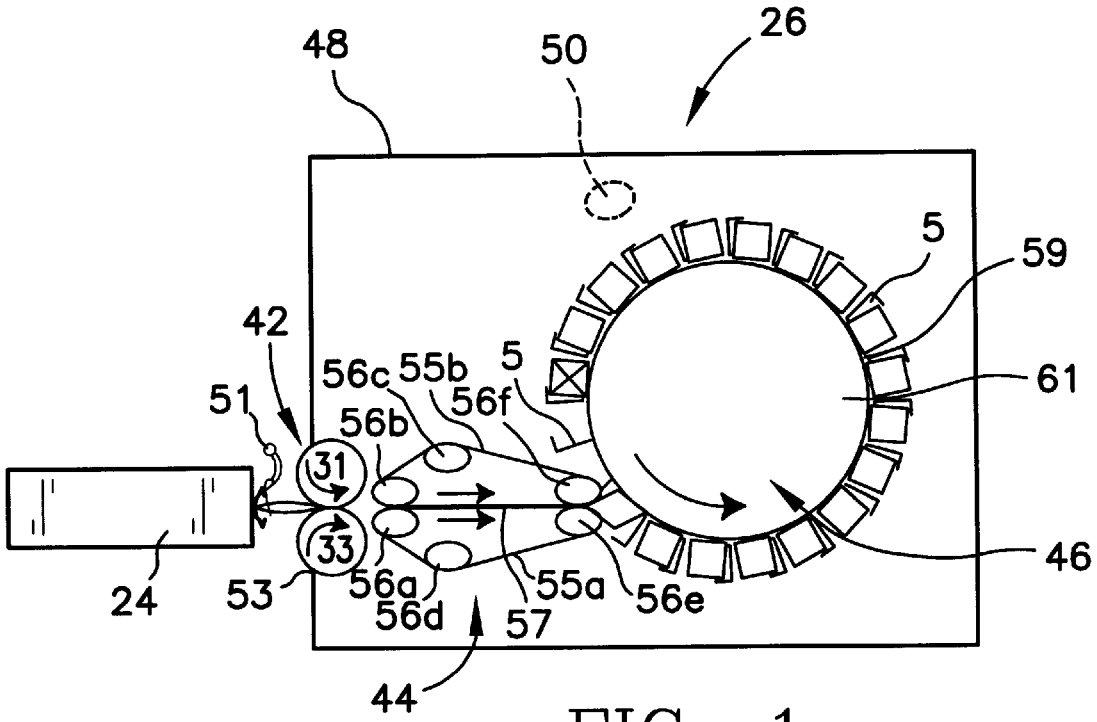
FIG. 1 is a top plan view of the infeed sterilizer of the present invention.

As shown in FIG. 1, the infeed sterilizer 26 of the present invention generally includes a nip roller 42, an infeed conveyor 44, a sterilization carousel 46, a sterilization chamber 48 and means 50 for introducing a sterilant onto each of the erected cartons 40. A plurality of carton blanks 22 are fed from a magazine 24 to the nip roller 42 of the infeed sterilizer 26. Each blank 22 may be picked by a reciprocating suction cup arm 51 which transports each carton blank 22 from the magazine 24 to the nip roller 42. The nip roller 42 is generally composed of two rotating cylinders 31 and 33 that engage the carton blank 22 and draw it into the sterilization chamber 48. The rotating cylinders 31 and 33 may be rubber coated or composed of an equally forgiving material such that the carton blanks 22 will not be damaged when drawn into the sterilization chamber 48. The nip roller 42 overbreaks the blanks 22 reducing the blanks 22 memory/tendency to revert to a diamond shape. In a preferred structure, the majority of the cylinders 31 and 33 are rotating within the sterilization chamber 48 allowing them to be exposed to the sterilant. The nip roller 42 is positioned within an egress 53 to the sterilization chamber 48, and acts as a barrier to unwanted particles entering the sterilization chamber 48. From the nip roller 42, the blanks 22 are transferred to the infeed conveyor 44. In an alternative embodiment, the blanks may be directly transferred to the sterilization carousel 46.

The exterior of the flat blanks 22 may be sterilized at an infeed conveyor 44 before being transferred to a sterilization carousel 46. The infeed conveyor 44 is generally composed of a pair of continuous belts 55*a–b* moving about a corresponding set of rotating cylindrical drums 56*a–f*. The belts 55*a–b* move parallel to each other along a straight blank pathway 57 before being directed opposite each other and then in a substantially counter direction before again moving along the blank pathway 57. The belts 55*a–b* may be composed a material similar to the coating of the cylinders 31 and 33 of the nip roller 42. The infeed conveyor 44 basically performs two functions: the transport of blanks from the nip roller 42 to the sterilization carousel 46 in a substantially controlled movement; and the possible sterilization of the exterior of the blanks 22.

Figure 5:
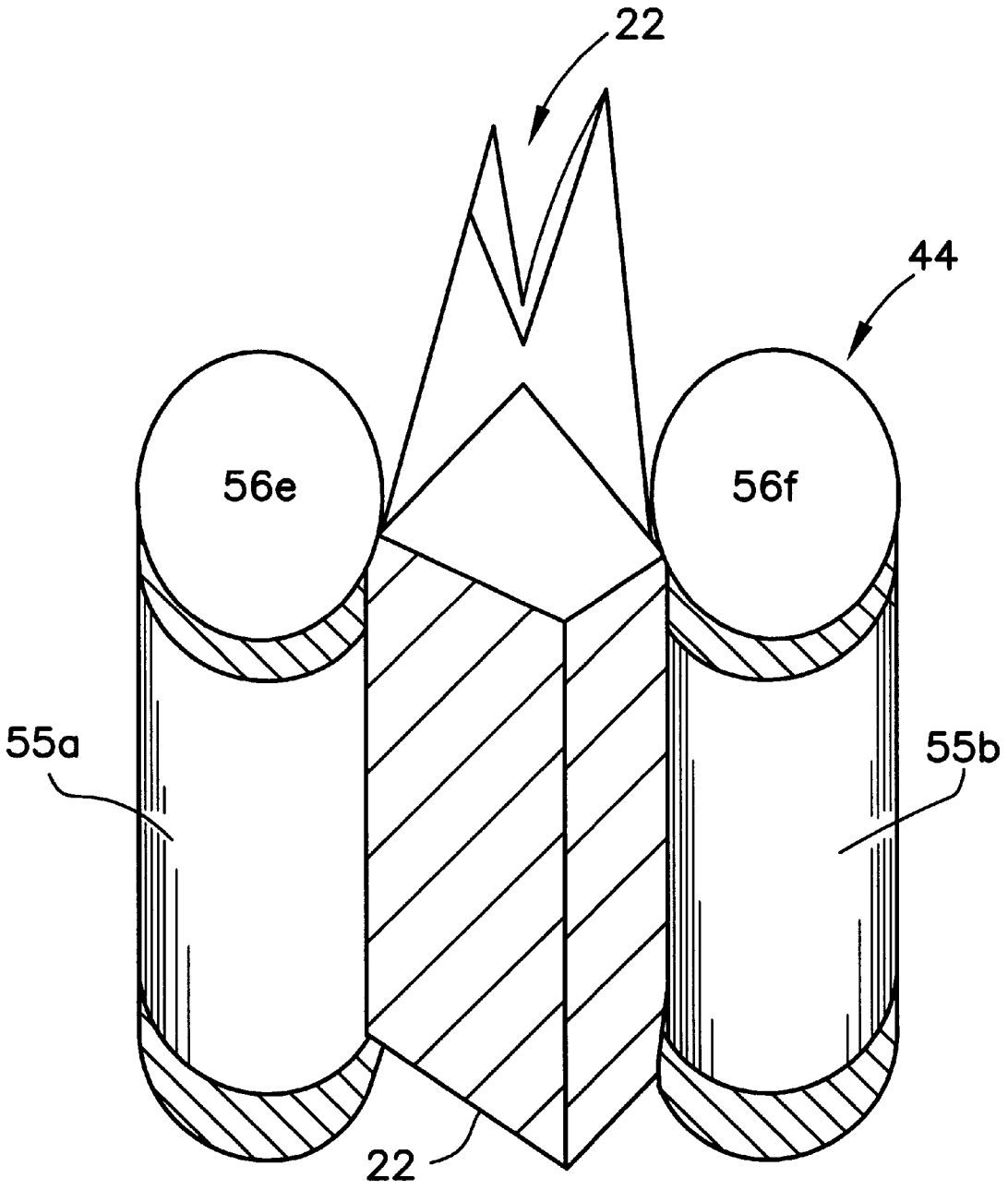
FIG. 5 is a top perspective view of the egress of a carton from the infeed conveyor of the infeed sterilizer of the present invention.
Figure 6:
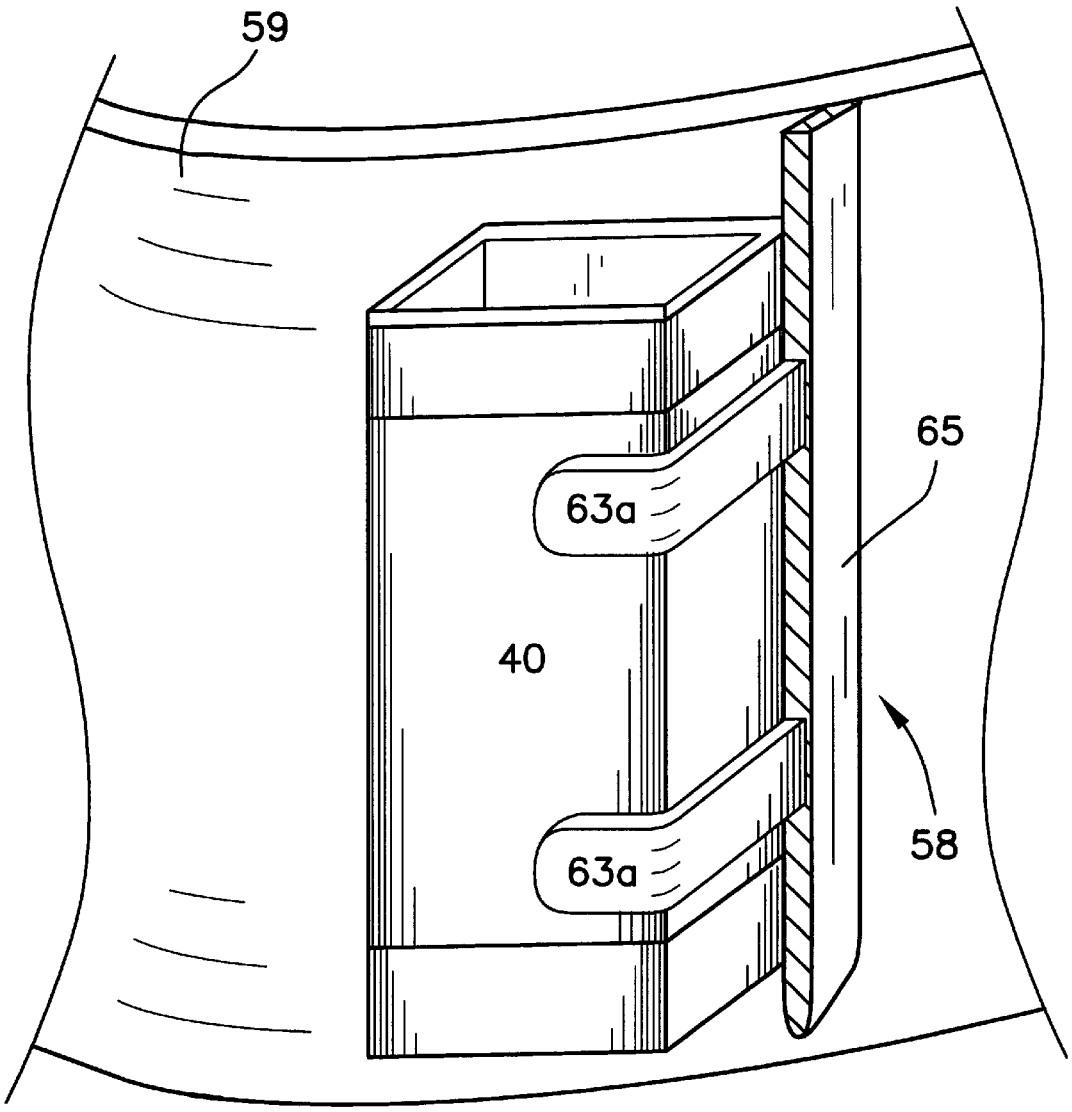
FIG. 6 is an isolated view of a carrier with a carton engaged therewith.

Upon egress from the infeed conveyor 44, as shown in FIG. 5, the flat carton blanks 22 are erected to a partially formed carton 40 and positioned within carriers 58 on the sterilization carousel 46. The plurality of carriers 58 may be attached to a track 59, or set of tracks 59, connected to a rotating turret 61. The carriers 58 may assume several different configurations, however, each configuration should be open to accept a carton 40, be capable of holding the carton 40 as it is rotated on the carousel 46, be capable of allowing for the transfer of the carton 40 to a higher level above the carousel 46, and be capable of allowing for the introduction of a sterilant onto the interior of the carton 40. Such carriers 58 are described in U.S. Pat. No. 5,488,812 entitled Packaging Machine, U.S. Pat. No. 5,155,968 entitled Continuous To Intermittent Feeding Interface, and U.S. Pat. No. 5,460,262 entitled Conveyor Assembly, all of which relevant parts are hereby incorporated by reference. One possible embodiment of the carrier engaged with a carton 40 is illustrated in FIG.6. As shown in FIG. 6, this particular embodiment of carrier 58 has a first arm 63*a* and a second arm 63*b* protruding from a brace 65 for temporarily grasping the carton 40. The arms 63*a–b* may have a vacuum or suction mechanism integrated therein, and/or may have maneuverability about a fixed axis for retention and release of the carton 40.

The interior, as well as the exterior, of the cartons 40 may be sterilized during rotation on the sterilization carousel 46. The rotation of the cartons 40 is indexed to allow for placement and displacement of the cartons on the carousel 46. Thus, the carousel 46 will have stationary timeframe and a movement timeframe. The stationary timeframe will correspond to the event requiring the greatest amount of time. This event may be the placement of the carton 40 on the carousel 46, the displacement of a carton 40 from the carousel 46, or if applicable the attachment of a fitment to the carton 40 while the carton 40 is held on the carousel 46. Such fitment applicators are well known in the art and need not be described herein. The movement timeframe may proceed as quickly as possible without dislodging the carton 40 from its carrier 58, or without causing an adverse air current within the sterilization chamber 48. The speed of this movement timeframe may be much greater than on a traditional linear packaging machine where the conveyance must take into account the movement of a carton filled with a product. In the present invention, the carton 40 is not yet filled with a product, therefore, sloshing of the product is not of concern which allows for greater production speeds.

A very important aspect of the present invention is that, unlike typical packaging machines where the bottom of the carton is formed prior to sterilization, the present invention allows for the carton 40 to be sterilized prior to any bottom forming which allows for the sterilization of the portions of the carton (the bottom panels) that are typically folded and sealed, and thus unsterilized. A sterilant, such as gas-phase hydrogen peroxide may be flowed onto each carton 40 while the cartons 40 are rotated on the sterilization carousel 46. Alternatively, a fine mist of a sterilant such as liquid hydrogen peroxide may be sprayed into the interior of each carton 40 at a station along the carousel 46. Hot air blowers may also be positioned along the carousel 46 to force hot air into the interior of the cartons 40. Further, ultraviolet radiation may be employed at a station along the carousel 46 to direct ultraviolet radiation into the interior of the cartons for sterilization purposes. An electron beam mechanism may also be employed at a station along the carousel 46 to direct electrons into the interior of the cartons for sterilization purposes. Although the main focus is the interior of the carton 40, the exterior is also subject to sterilization within the sterilization chamber 48.

In order to maintain the sterile environment, sterile air may be directed into the chamber 48 to pressurize the chamber 48 and to reduce the potential of contaminants to disperse throughout the chamber 48. Methods for introducing sterile air into a chamber are known within the art, and one possible method/system is disclosed in co-pending U.S. patent application No. 08/828,931, filed on Mar. 28, 1997 now U.S. Pat. No. 5,858,040 and entitled Filling Machine having A Microfiltrated Air Supply System which relevant parts are hereby incorporated by reference.

The transfer of each carton 40 from the carousel 46 to bottom forming, filling and top sealing stations should be accomplished without recontamination of the carton 40, especially the interior, by the transfer mechanism.

Figure 2:
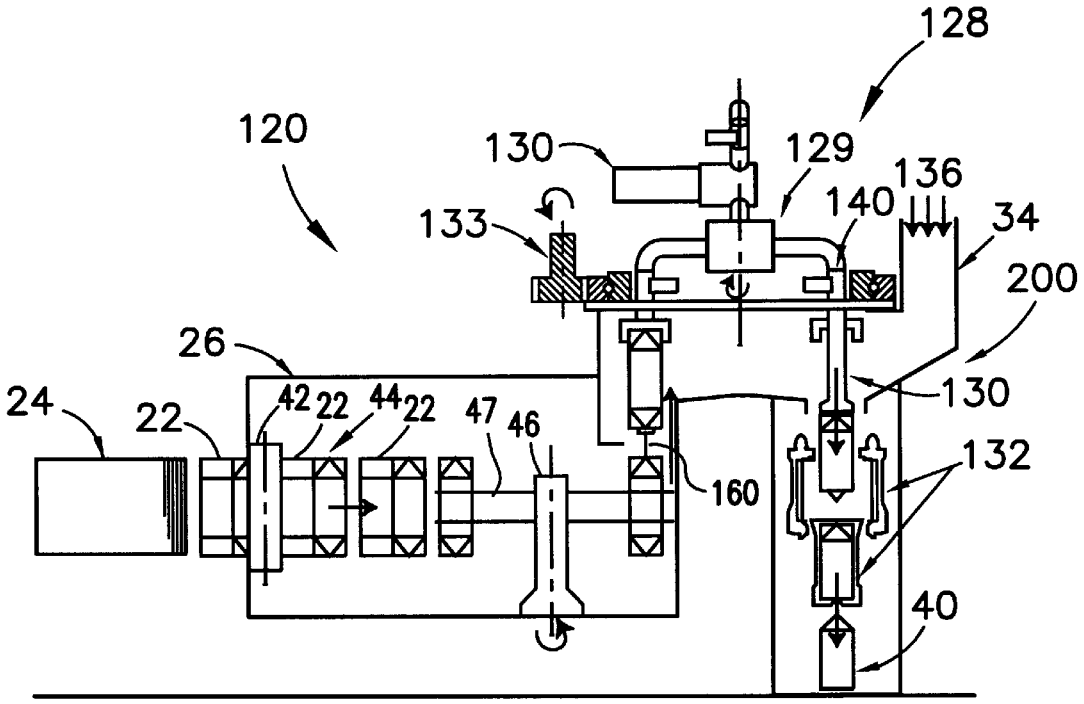
FIG. 2 is a schematic view of a preferred embodiment of the infeed sterilizer on a packaging machine.

As shown in FIG. 2, a packaging machine is generally designated 120. The packaging machine 120 is provided with a series of carton blanks 22 from the magazine 24. The packaging machine 120 generally includes the infeed sterilizer 26, a form and fill carousel 128 with a plurality of filling mandrels 130 thereon, and a top sealing mechanism 132. The forming, filling and sealing operations are all performed within a sterile barrier 134 that is pressurized by a supply of sterile air 136 flowing therein. The sterile barrier forms an enclosed environment about the components of the packaging machine 120.

Figure 3:
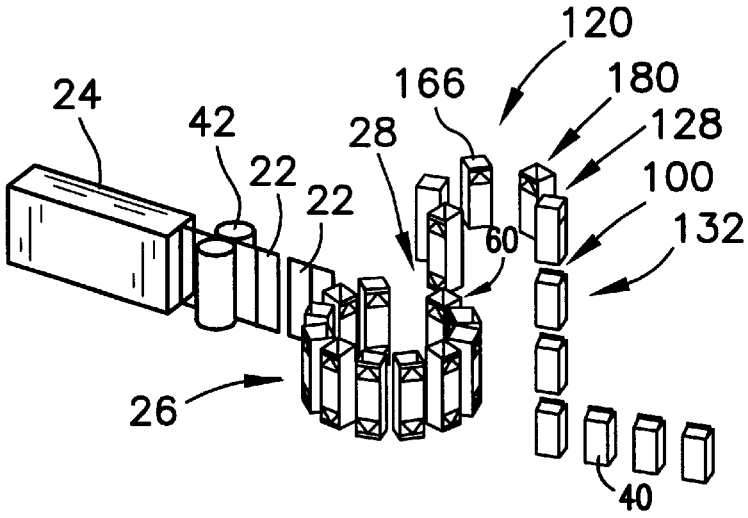
FIG. 3 a schematic top view of the progression of cartons on the packaging machine of FIG. 2.
Figure 4:
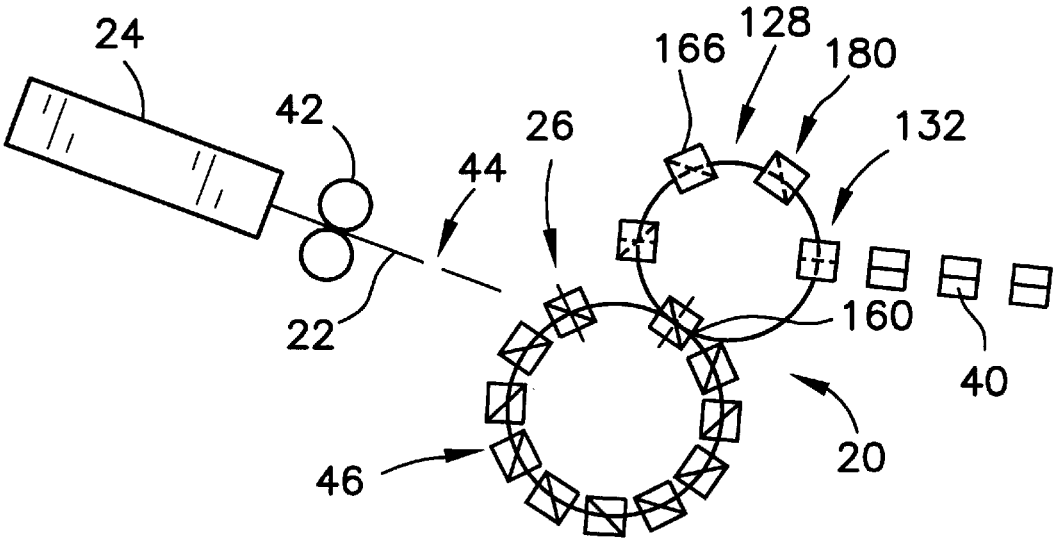
FIG. 4 is a schematic top plan view of FIG. 3.

The progression of carton blanks 22 to finished cartons 40 is shown in FIGS. 2–4, however, FIG. 3 provides an isolated view of the fabrication of the cartons 40 on the packaging machine 120. A further explanation of the packaging machine is provided in co-pending U.S. patent application Ser. No. 09/141,695, filed on even date herewith of the present Application, entitled Filling Machine, and hereby incorporated by reference. The infeed sterilizer 26 sterilizes each carton 40 in preparation of further forming and filling on the machine 120 which is performed on the carousel 28, or in a standard type form, fill and seal machine.

A carton lifter 160 transfers the sterilized carton blank 22 to the form and fill carousel 28. The lifter 160 places the carton 40 on a filling mandrel 130 for processing on the carousel 128. After each carton 40 is lifted onto the carousel 128, the carton 40, attached to a mandrel 130, is rotated about a central turret 129 to various stations for bottom forming and eventually filling. The carousel is driven by a drive pinion mechanism 133. The bottom panels 162 of a carton 40 are heated and the top panels of each carton 40 may also be heated. A preferred heating method is to flow hot air onto the panels through a hot air blower, not shown. The hot air heats the thermoplastic coating of the carton to its melting temperature allowing for eventual chemical bonding for sealing purposes. At a filling and top sealing station 200, the carton is filled with a desired product such as milk or juice, as it is pulled off of the filling mandrel 130. The flow of product to a fill tube 204 within the filling mandrel 130 is controlled by a metering pump 230 mounted on the turret 129 of the form and fill carousel 128. The metering pump 230 ensures that the proper amount of product is provided for each carton.

During the filling procedure, a carton 40 that has been previously bottom formed on the mandrel 130 is rotated to a filling position and lowered along a longitudinal pathway. At the end of the downward movement, the open end, and more likely than not the top end, is sealed together to form a finished product. The top sealing is accomplished by the top sealing mechanism 132 which will be described in more detail the top sealing mechanism is provided in co-pending U.S. patent application Ser. No. 09/141,696, filed on an even date herewith the filing of the present application, entitled Vertical Sealing Assembly For A Packaging Machine, and which is hereby incorporated by reference in its entirety.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as my invention:

1. An infeed sterilizer for a packaging machine, the infeed sterilizer comprising:

a sterilization chamber having an ingress and an egress;

a nip roller for receiving a plurality of carton blanks, the nip roller defined by first and second rotating rollers positioned at the ingress to the sterilization chamber;

a carousel disposed within the sterilization chamber, the carousel having a plurality of carriers thereon, each carrier temporarily holding an erected carton blank having an open top end and an open bottom end during sterilization thereof, the carousel rotating about a fixed axis;

a non-immersion sterilizing assembly associated with the carousel, the sterilizing assembly disposed within the sterilization chamber and configured to sterilize each erected carton blank during rotation on the carousel, wherein the nip roller is configured to provide a barrier to entry of contaminants into the sterilization chamber.

2. The infeed sterilizer according to claim 1 further comprising a conveyor for transferring each of the plurality of carton blanks from the nip roller to a carrier on the carousel.

3. The infeed sterilizer according to claim 1 further comprising a supply of sterile air introduced into the sterilization chamber.

4. The infeed sterilizer according to claim 1 wherein the non-immersion sterilizing assembly is gas-phase hydrogen peroxide.

5. The infeed sterilizer according to claim 1 wherein the non-immersion sterilizing assembly is a liquid hydrogen peroxide spray assembly that sprays liquid hydrogen peroxide into the interior of each of the cartons at a station disposed about the carousel.

6. The infeed sterilizer according to claim 1 wherein the non-immersion sterilizing assembly is a hydrogen peroxide spray assembly for introducing hvdrogen peroxide into the interior of each of the erected carton blanks at a station on the carousel and an ultraviolet energy emission assembly directed into the interior of each of the erected carton blanks at a station subsequent to the hydrogen peroxide station on the carousel.

7. The infeed sterilizer according to claim 1 wherein each carrier is connected to a track on the carousel and rotated at an indexed movement corresponding to a predetermined timeframe.

8. A method for sterilizing cartons on a packaging machine, the method comprising:

providing a sterilization chamber having an ingress and an egress and a nip roller at the ingress, the nip roller configured to establish a barrier to entry of contaminants into the sterilization chamber;

drawing a carton blank into the sterilization chamber via the nip roller;

transferring the carton blank to a sterilization carousel within the sterilization chamber placing the carton blank onto a carrier carried by the sterilization carousel, the carton blank placed on the carrier in an erected state wherein the top end of the carton is open and the bottom end of the carton is open; and non-immersion sterilizing the erected carton blank during rotation on the sterilization carousel.

9. The method according to claim 8 wherein the erected carton blank is sterilized with gas-phase hydrogen peroxide.

10. The method according to claim 8 wherein the erected carton blank is sterilized with liquid hydrogen peroxide.

11. The method according to claim 8 wherein the erected carton blank is sterilized with the combination of hydrogen peroxide and ultraviolet energy.

12. The method according to claim 8 further comprising transferring the sterilized erected carton blank to a form and fill carousel positioned on a level above the sterilization carousel.

* * * * *